US011130629B1

(12) United States Patent
Vaselaar et al.

(10) Patent No.: US 11,130,629 B1
(45) Date of Patent: Sep. 28, 2021

(54) REFUSE COLLECTION VEHICLE HAVING A SIDE MOUNTED REFUSE CONTAINER TIPPER

(71) Applicants: Cory A. Vaselaar, Sheldon, IA (US); Craig G. Broyhill, Dakota City, NE (US)

(72) Inventors: Cory A. Vaselaar, Sheldon, IA (US); Craig G. Broyhill, Dakota City, NE (US)

( * ) Notice: Subject to any disclaimer, the term of this patent is extended or adjusted under 35 U.S.C. 154(b) by 0 days.

(21) Appl. No.: 17/318,297

(22) Filed: May 12, 2021

(51) Int. Cl.
*B65F 3/04* (2006.01)
*B65F 3/02* (2006.01)

(52) U.S. Cl.
CPC ..... *B65F 3/046* (2013.01); *B65F 2003/0223* (2013.01); *B65F 2003/0226* (2013.01)

(58) Field of Classification Search
CPC ..... B65F 3/0213; B65F 3/04; B65F 3/041; B65F 3/046; B65F 2003/0223; B65F 2003/0226; B65F 2003/023
See application file for complete search history.

(56) References Cited

U.S. PATENT DOCUMENTS 3,516,562 A * 6/1970 Knight ..... B65F 3/041 414/408
3,604,577 A * 9/1971 Heilmeier ..... B65F 3/04 414/421
5,525,022 A * 6/1996 Huntoon ..... B65F 3/001 414/408
5,807,056 A * 9/1998 Osborn ..... B65F 3/04 414/406
9,028,192 B2 * 5/2015 Wahls ..... B65F 1/1452 414/408
9,561,904 B1 * 2/2017 Osborn ..... B65F 3/046
9,834,377 B1 * 12/2017 Hayes ..... B65F 3/041
2010/0278620 A1 * 11/2010 Rimsa ..... B65F 1/122 414/408

FOREIGN PATENT DOCUMENTS

DE 102004008952 A1 * 9/2005 ..... B65F 3/04
DE 202020003149 U1 * 10/2020 ..... B65F 3/041

* cited by examiner

*Primary Examiner* — James Keenan
(74) *Attorney, Agent, or Firm* — Dennis L. Thomte; Thomte Patent Law Office LLC

(57) ABSTRACT

A refuse container or can tipper apparatus is mounted at the passenger side of a refuse collection vehicle having a refuse box with an open upper end. The apparatus includes a pair of lifting arms and a pair of pivot arms which are pivotally connected to a vertically disposed support member which includes a hydraulic cylinder or an electric linear activator for pivotally moving the pair of lifting arms and the pair of pivot arms. The outer ends of the lifting arms and pivot arms have a can or container engagement assembly secured thereto which may be a grip arm assembly or a hook plate assembly. The can engagement assembly is moved into contact with the refuse container and lifts the refuse container to a position above the refuse box and dump the refuse in the refuse container into the refuse box.

6 Claims, 17 Drawing Sheets

REFUSE COLLECTION VEHICLE HAVING A SIDE MOUNTED REFUSE CONTAINER TIPPER

BACKGROUND OF THE INVENTION

Field of the Invention

This invention relates to a refuse container tipper which is mounted at the side end of a refuse collection vehicle. More importantly, this invention relates to a unique lifting arm assembly which enables a refuse container or can to be lifted from a supporting surface to a tipped position above the open upper end of the refuse box of the refuse collection vehicle and to dump the contents of the refuse container into the box of the refuse collection vehicle. Even more importantly, this invention relates to a unique lifting arm assembly which may have either a grip arm assembly or a hook plate assembly secured to the outer ends of the lifting arms and pivot arms.

Description of the Related Art

There have been numerous prior art refuse collection vehicles which are able to lift a filled refuse container or can from the ground or other supporting surface and to dump the contents of the refuse container into the box of the refuse collection vehicle. However, many of the prior art refuse collection vehicles are extremely expensive, are difficult to maintain and suffer from operational problems. One type of prior art refuse collection vehicles utilizes a grip arm assembly at the outer ends of the lifting arms thereof. Another type of prior art refuse collection vehicles utilizes a hook plate assembly at the outer end of the lifting arms thereof. To the best of Applicants' knowledge, there is no refuse collection vehicle which utilizes interchangeable grip arm assemblies and hook plate assemblies without extensive mechanical alteration of the lifting arm assemblies thereof.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A lifting arm assembly is mounted at the side of a refuse collection device and which is designed to lift a refuse container from a supporting surface to a position over the upper end of the refuse box of the refuse collection device and to dump the container of the refuse container into the refuse box of the refuse collection vehicle.

A can lifting and dumping assembly is positioned at the passenger's side of the frame of the vehicle which includes a pivotal lifting arm and dumping assembly having an inner end and an outer end. The outer end of the can lifting and dumping assembly has a can engagement assembly secured thereto for having either a can grip assembly or a hook plate assembly secured thereto.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
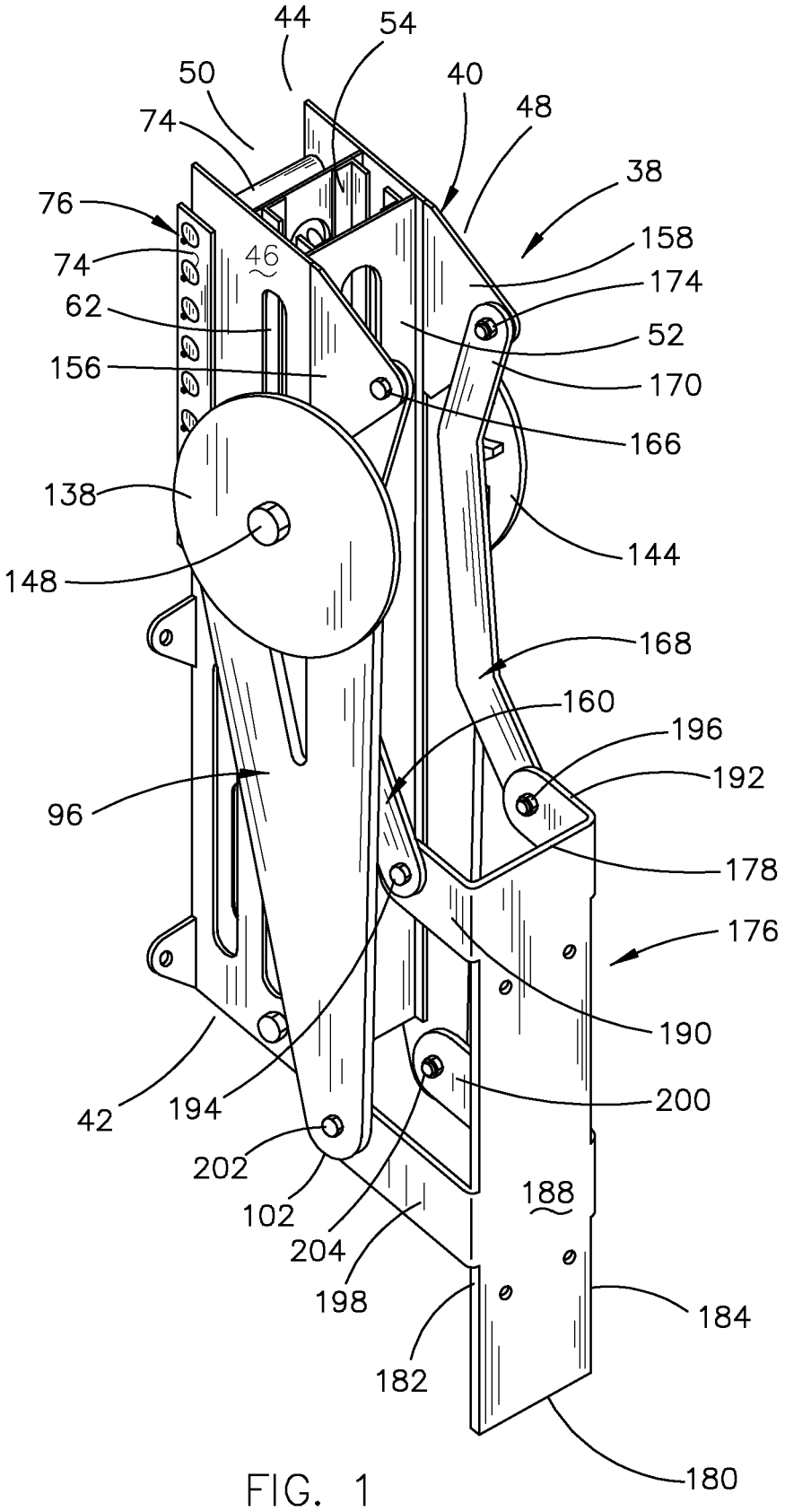
FIG. 1 is a perspective view of the basic lifting arm assembly of this invention, in the folded position, and which is configured to be mounted on the side of a refuse collection vehicle.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a refuse collection vehicle which may be of several different configurations. Vehicle 10 includes a forward end 12, a rearward end 14, a first or driver's side 16, a second or passenger's side 18, a frame 20 and a cab 22. A refuse hopper or box 24 is mounted on the frame 20 rearwardly of the cab 22. Refuse hopper 24 includes a bottom 26, a front wall 28, a first side wall 30, a second side wall 32 and a rear wall 34. Hopper 24 has an open upper end 36.

The numeral 38 refers to the refuse can lifting and tipping assembly of this invention. Assembly 38 is mounted at the passenger's side 18 of vehicle 10 as seen in the drawings. Assembly 38 includes a mounting structure 39 which is secured to the frame 20 of vehicle 10. Assembly 38 includes an upstanding, generally vertically disposed support member 40 having a lower end 42, an upper end 44, a rear side 46, a front side 48, an inner side 50, an outer side 52 and an interior 54. Support member 40 has a plurality of mounting plates 55 extending therefrom.

A hydraulic cylinder 56 is positioned in the interior 54 of support member 40. Hydraulic cylinder 56 may be replaced with an electric linear actuator device of conventional design. Cylinder 56 includes a base end 58 which is fixed to the lower end of support member 40 by pin 59. Cylinder 56 includes a rod end 60 as will be described hereinafter. The rear side 46 of support member 40 includes a vertically disposed and elongated slot 62 formed therein. The front side 48 of support member 40 includes a vertically disposed slot 64 formed therein.

The rear side 46 of support member 40 includes a vertically disposed row 66 of vertically spaced-apart pin openings 68 formed therein. The front side 48 of support member 40 includes a vertically disposed row 70 of vertically spaced-apart pin openings 72 formed therein. The pin openings 72 are aligned with the pin openings 68. Elongated pins 74 extend between the aligned pin openings 68 and 72. The ends of each of the pins 74 are positioned outwardly of rear side 46 of support member 40 and outwardly of front side 48 of support member 40 respectively. The pins 74 are spot-welded to the rear side 46 and the front side of support member 48 respectively to maintain the pins 74 in place.

A vertically disposed and elongated flat plate 76, having a plurality of vertically placed-apart pin openings 78 formed therein, is positioned at the rear side 46 of support member 40 and is secured to the outer ends of the pins 74 by tack welding so as to create a space 80 between the plate 76 and rear side 46 of support member 40. A vertically disposed and elongated flat plate 82, having a plurality of vertically spaced-apart pin openings 84 formed therein, is positioned at front side 48 of support member 40 and is secured to the outer ends of pins 74 by tack-welding so as to create a space 86 between the plate 82 and front side 48 of support member 40.

The numeral 88 refers to a first or rear sprocket arm assembly which includes a sprocket 90 having sprocket teeth 92. Sprocket 90 has a pivot pin opening 94 formed therein. An elongated sprocket arm 96 has its inner end 98 secured to sprocket 90 as seen in the drawings. The outer end 102 of sprocket arm 96 has an opening 104 formed therein. Sprocket arm 96 has an outer side 106 and an inner side 108. Sprocket arm 96 has an opening 110 formed therein.

The numeral 112 refers to a second or front sprocket arm assembly which includes a sprocket 114 having sprocket teeth 116. Sprocket 114 has a pivot pin opening 118 formed therein. An elongated sprocket arm 120 has its inner end 122 secured to sprocket 114 as seen in the drawings. The sprocket arm 120 has an opening 124 formed therein. The outer end 126 of sprocket arm 120 has an opening 128 formed therein.

The rear sprocket arm assembly 88 is positioned relative to the rear side 46 of support member 40 so that the opening 94 in sprocket 90 registers with slot 62 in rear side 46 of support member 40 and so that a portion of the sprocket 90 is received in the space 80 between plate 76 and rear side 46 of support member 40 and so that some of the sprocket teeth 92 of sprocket 90 engage the ends of the pins 74. A washer 136 is positioned at the inner side of sprocket 90. A protective plate 138 is positioned outwardly of washer 136 and has a pin opening 140 formed therein.

The front sprocket arm assembly 112 is positioned relative to the front side 48 of support member 40 so that opening 118 in sprocket 114 registers with slot 64 in front side 48 and so that a portion of the sprocket 114 is received in the space 86 between plate 82 and front side 48 of support member 40 and so that some of the sprocket teeth 116 of sprocket 114 engage the ends of the pins 74. A washer 142 is positioned at the inner side of sprocket 114. A protective plate 144, having a pin opening 146 formed therein, is positioned outwardly of washer 142. A pivot bolt 148 extends inwardly through the central opening 140 in protective plate 138, through opening 94 in sprocket 90, through washer 136, through slot 62 in rear side 46 of support member 40, through slot 64 in front side 48 of support member 40, through washer 142, through opening 118 in sprocket 114, and through the central opening 146 in protective plate 144. A nut 150 is mounted on the end of bolt 148.

As stated above, the base end of hydraulic cylinder 56 is secured to the lower end of support member 40 by pin 59. The rod end 60 of hydraulic cylinder 56 has a tube 152 secured thereto. The pivot bolt 148 extends through the tube 152. Thus, when hydraulic cylinder 56 is completely retracted, the pivot bolt 148 will be in the lower end of slots 62 and 64 and the sprocket arm assemblies 88 and 112 will be in the lower position.

The numerals 156 and 158 refer to spaced-apart pivot plates which are secured to the outer side of support member 40 at the upper end of support member 40. The numeral 160 refers to an elongated pivot arm having an inner end 162 and an outer end 164. The inner end 162 of pivot arm 160 is pivotally secured to pivot plate 156 by bolt 166. The numeral 168 refers to an elongated pivot arm having an inner end 170 and an outer end 172. The inner end 170 of pivot arm 168 is pivotally secured to pivot plate 158 by bolt 174. The outer ends of link arms 160 and 168 have bolt openings formed therein.

The numeral 176 refers to a mounting plate having an upper end 178, a lower end 180, a rear side 182, a front side 184, an inner side 186 and an outer side 188. The upper end 178 of mounting plate 170 has a pair of spaced-apart brackets 190 and 192 which extend inwardly from mounting plate 176. The outer ends of pivot arms 160 and 168 are secured to brackets 190 and 192 by bolts 194 and 196, respectively.

Mounting plate 176 also has a pair of spaced-apart brackets 198 and 200 extending inwardly therefrom above the lower end 180 of mounting plate 176. The outer ends of sprocket arms 96 and 120 are connected to the inner ends of brackets 198 and 200 by bolts 202 and 204 respectively.

The numeral 206 refers to a refuse can or container having a lid 208 pivotally secured to the upper end of the body portion 210 of the container 206. The front wall 212 of body portion 210 has a protruding shoulder 214 at the upper end thereof. Shoulder 214 has a rectangular recess 216 which extends upwardly into the lower end thereof. The front wall 212 also has a horizontally disposed stop shaft 218 in the front wall 212. The container 206 is conventional in design. Some refuse collection vehicles use a hook plate apparatus which utilizes lifting arms having a vertical plate at the outer ends thereof which is extended upwardly into a recess in the container to lift and drop the container. Applicants use such a hook plate version or a gripper arm assembly in the invention.

The numeral 220 refers to a hook plate assembly which is utilized by Applicants. The numeral 222 refers to a gripper or grabber arm assembly which is also utilized by Applicants. Hook plate assembly 220 includes an upstanding frame 224 which includes a horizontally disposed lower frame member 226 having ends 228 and 230. A vertically disposed and generally rectangular plate 232 extends upwardly from frame member 226 and has sides 234 and 236 and an upper end 238. Wing members 240 and 242 extend horizontally from the sides 234 and 236 respectively. The frame 224 includes and angular stop bracket 244 extending outwardly therefrom. Assembly 220 may be selectively removably secured to mounting bracket 176 by bolts 246 extending through assembly 242 and mounting plate 176.

Thus, Applicants may use their assembly 38 to lift and dump containers 206. The vehicle 10 is driven to a spot near a container 206. The operator then utilizes the instant invention to insert the upper end 238 of the assembly 220 upwardly into the recess 216 in shoulder 214 of container 206. The container 206 is then lifted by Applicants' assembly 38 and dumped into the upper end 32 of the refuse hopper 24. The unique design of assembly 38 ensures that the container 206 will be sufficiently inverted so that all the refuse in the container 206 will be dumped into the refuse hopper 24.

Figure 2:
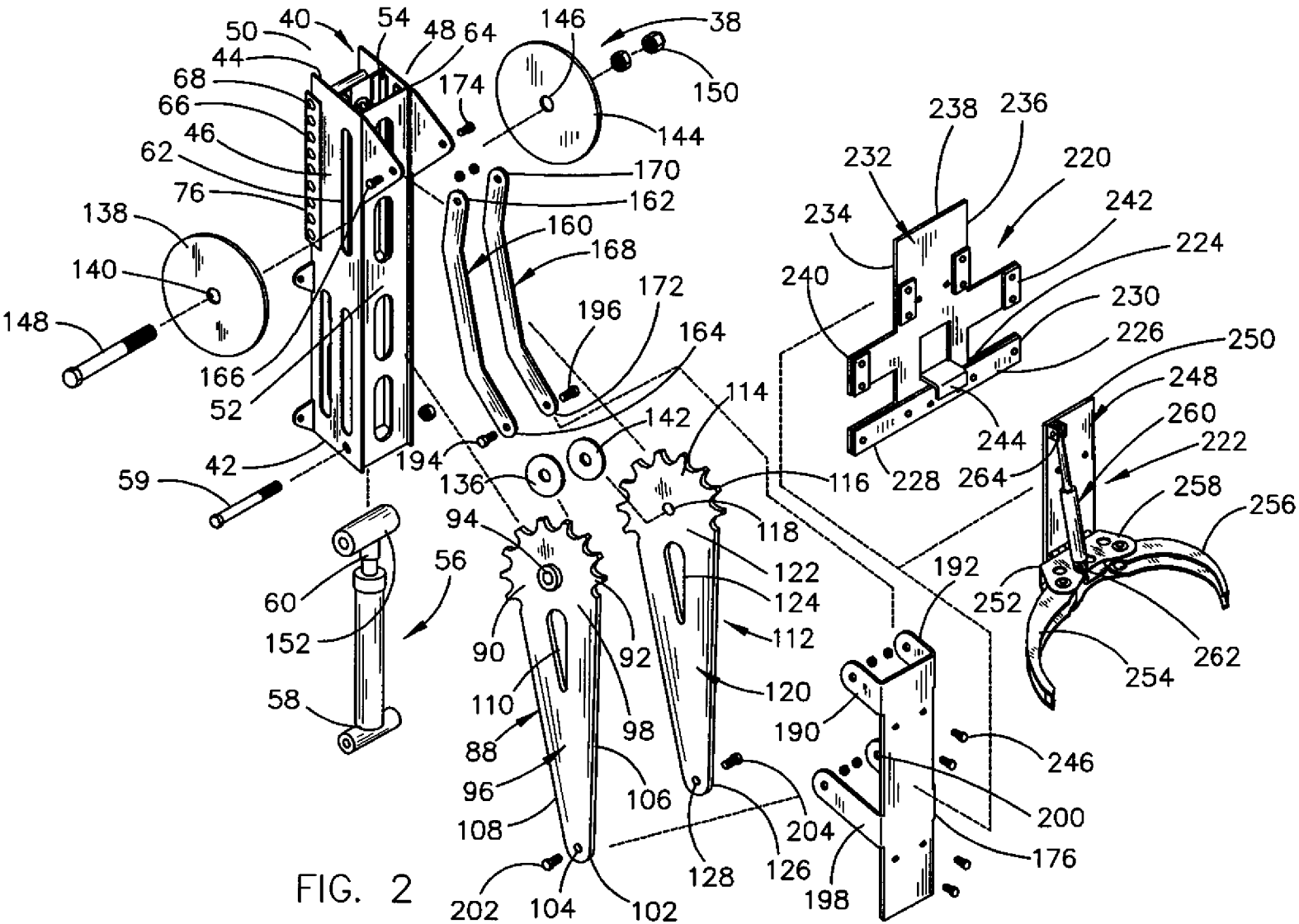
FIG. 2 is an exploded perspective view of the basic lifting arm assembly, the grip arm assembly and the hook plate assembly which may be attached to the basic lifting arm assembly.
Figure 3:
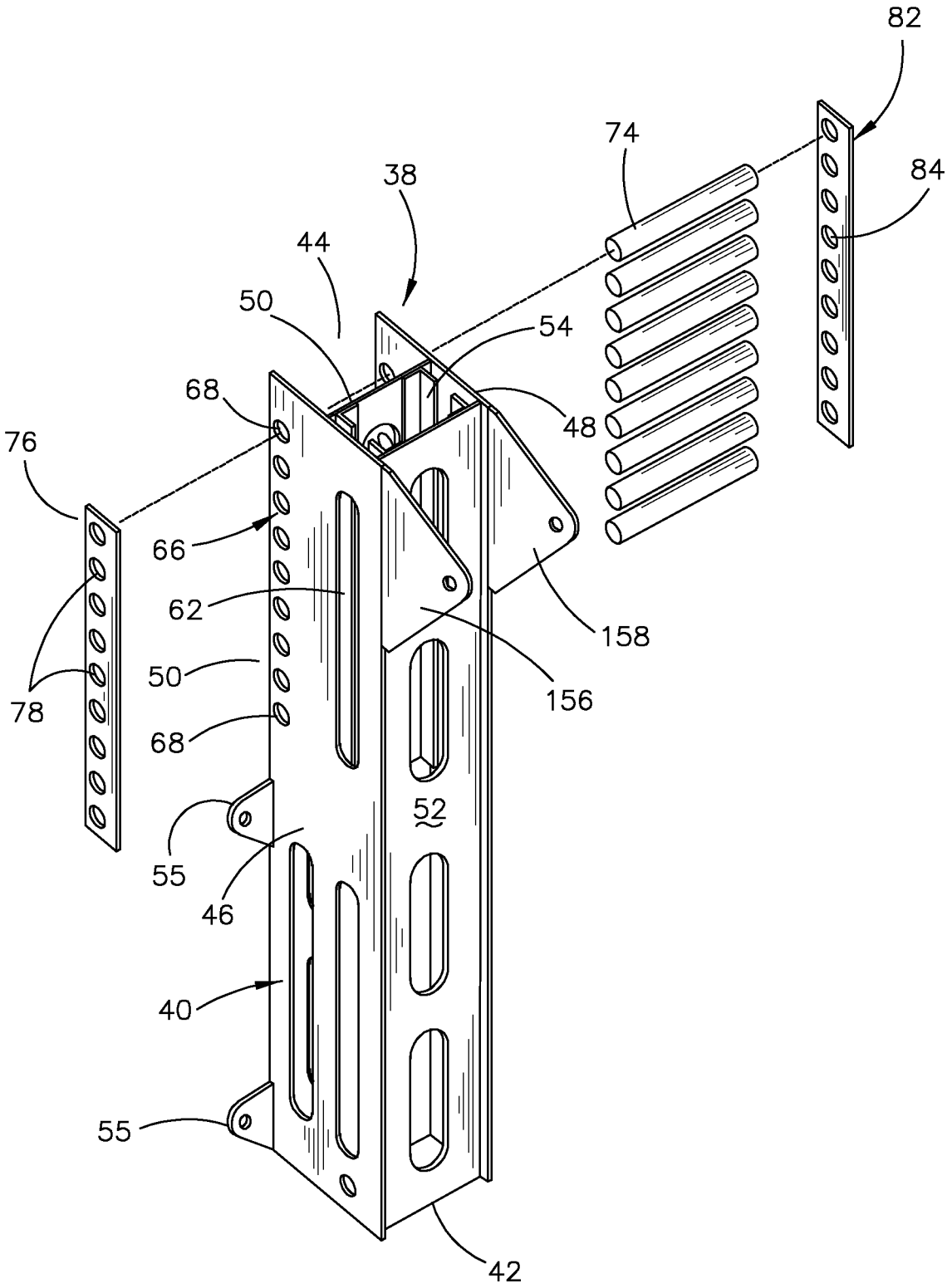
FIG. 3 is a rear perspective view of the vertically disposed support of the lifting arm assembly prior to the pins and plates thereof being installed.
Figure 4:
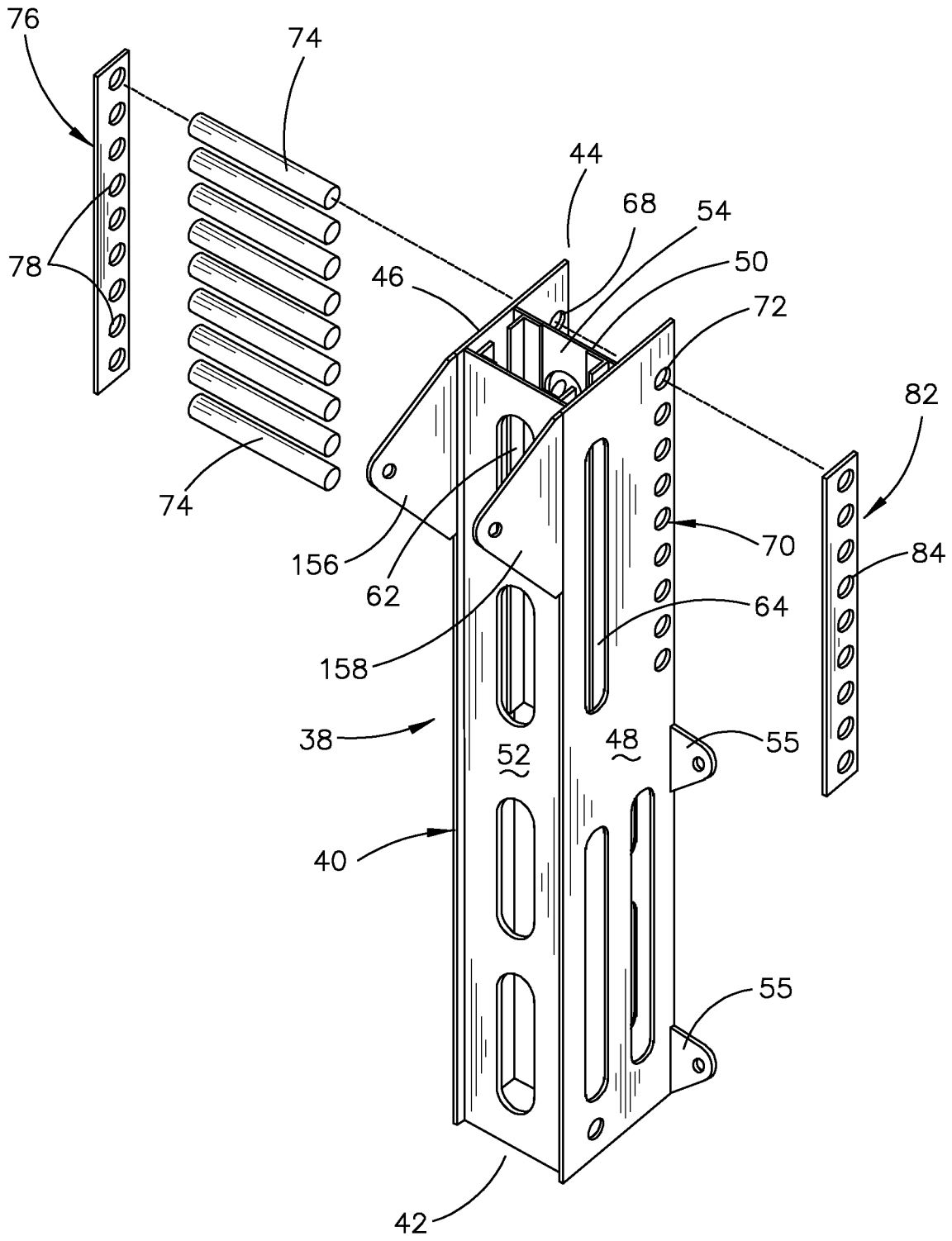
FIG. 4 is a front perspective view of the vertically disposed support of the lifting arm assembly prior to the pins and plate thereof being installed.
Figure 3A:
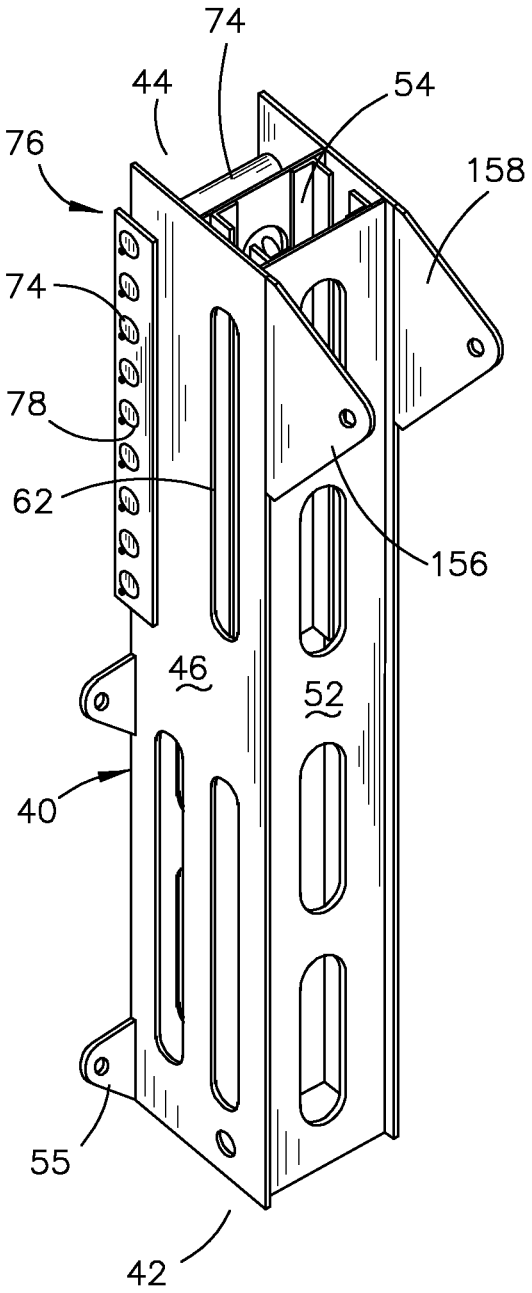
FIG. 3A is a rear perspective view of the vertically disposed support of the lifting arm assembly after the pins and plates thereof have been installed.
Figure 4A:
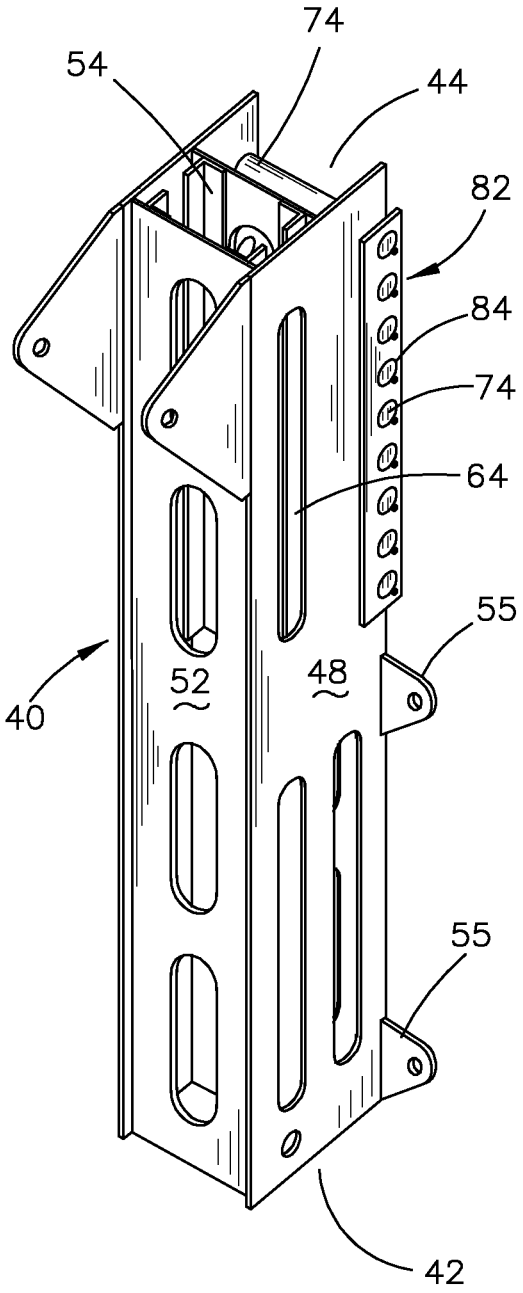
FIG. 4A is a front perspective view of the vertically disposed support of the lifting arm assembly after the pins and plate thereof being installed.
Figure 5:
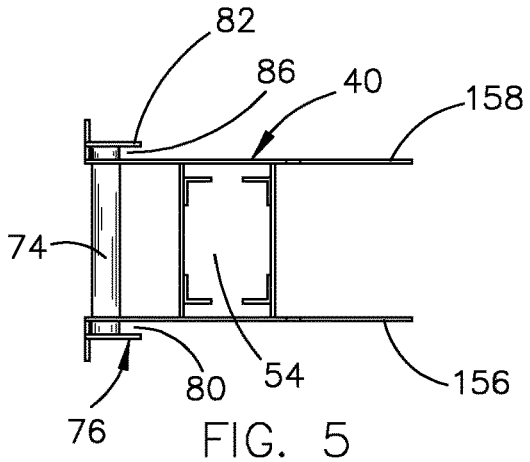
FIG. 5 is a top view of the upstanding support of the basic lifting arm assembly of FIG. 1.
Figure 6:
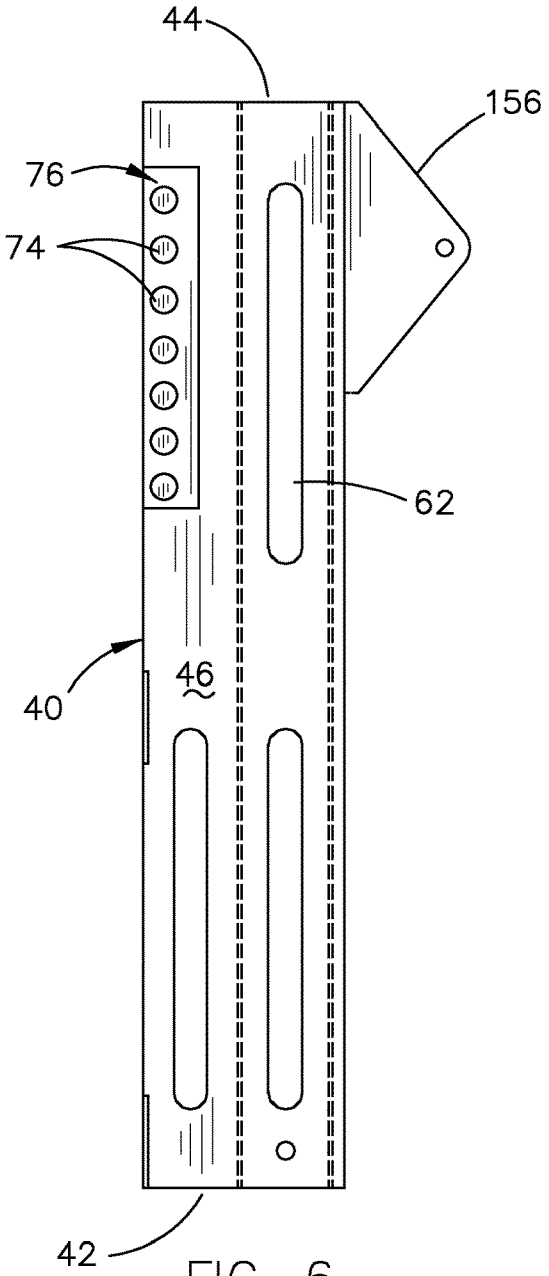
FIG. 6 is a side elevational view of the upstanding support of the basic lifting arm assembly of FIG. 1.
Figure 7:
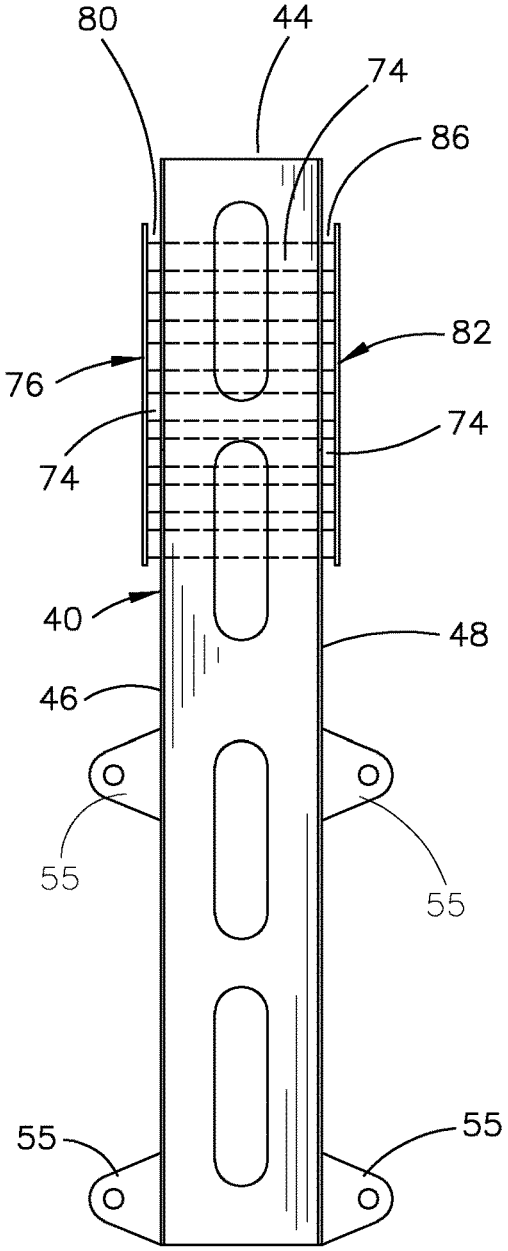
FIG. 7 is an outer elevational view of the upstanding support of the basic lifting arm assembly of FIG. 1.
Figure 8:
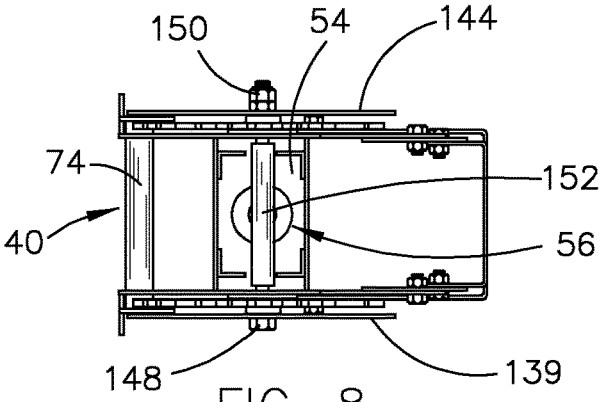
FIG. 8 is a top view of the upstanding support with components attached thereto.
Figure 9:
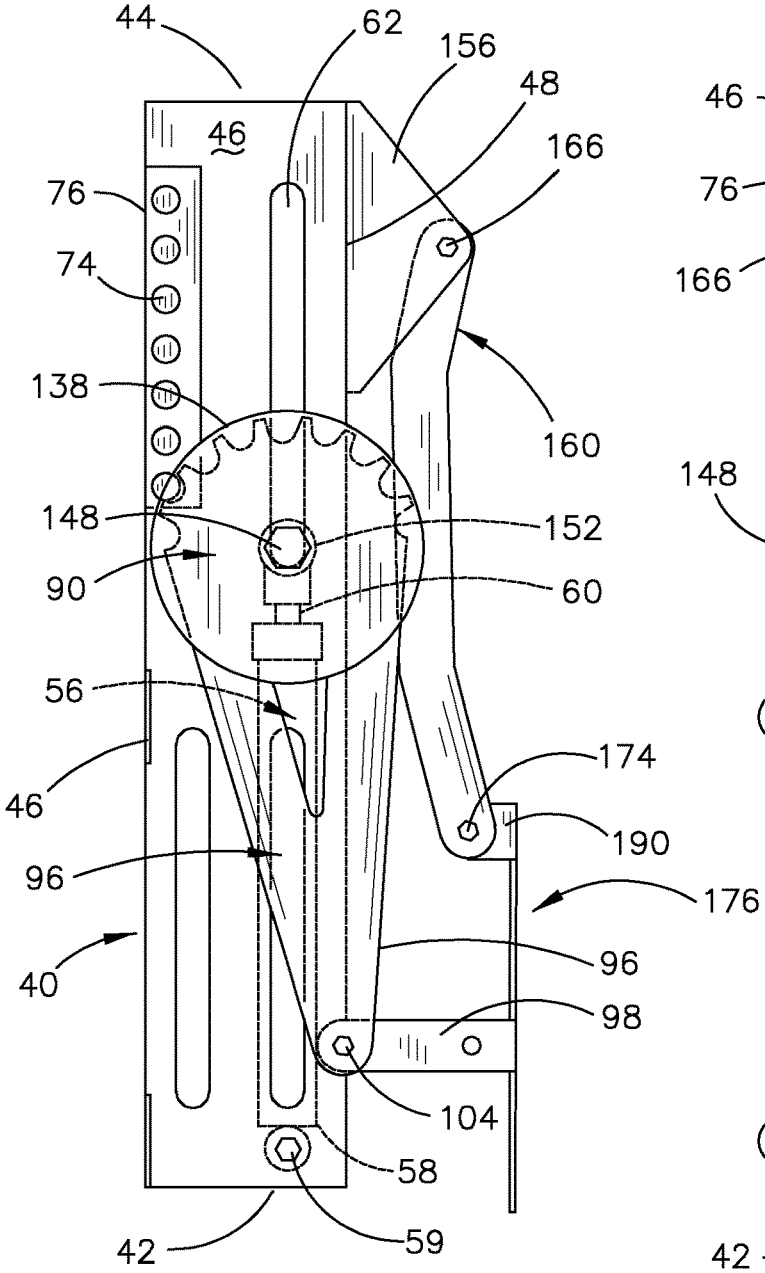
FIG. 9 is a side elevational view of the upstanding support with components attached thereto.
Figure 10:
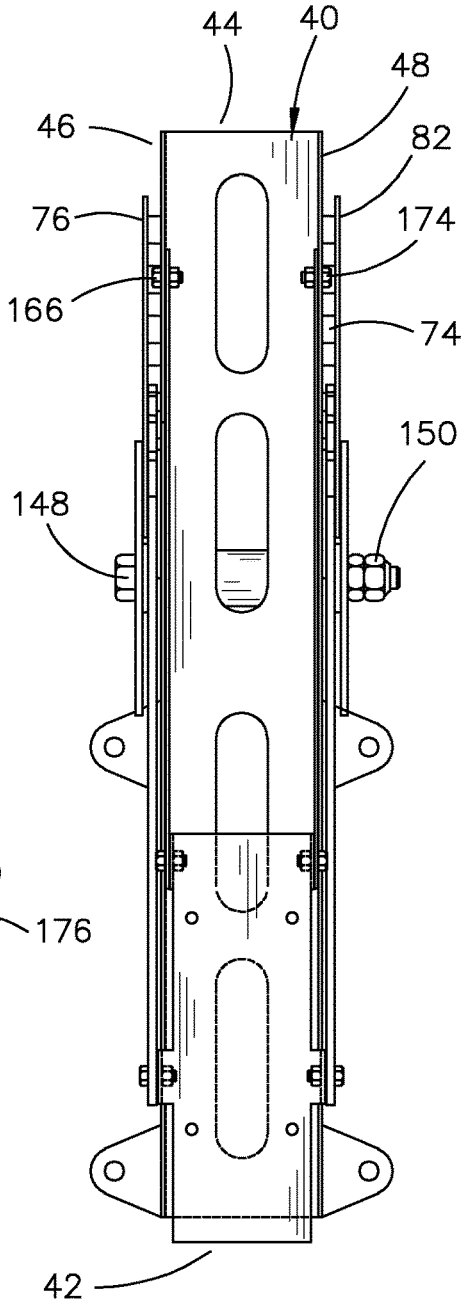
FIG. 10 is an outer elevational view of the upstanding support with components attached thereto.
Figure 11:
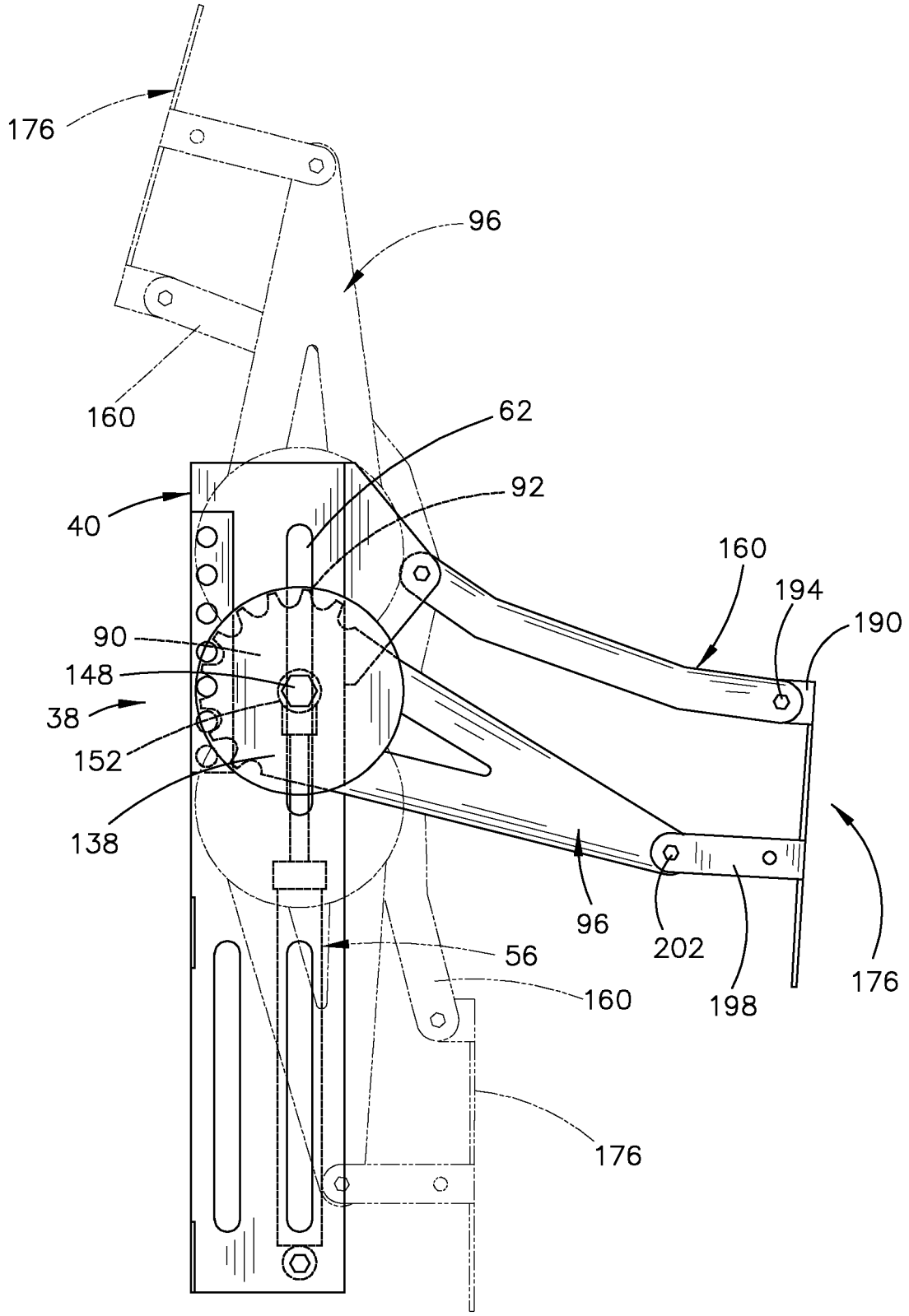
FIG. 11 is a side elevational view of the upstanding support with pivot arms extending therefrom and wherein the broken lines are depicting the pivot arms in a dumping position.
Figure 13:
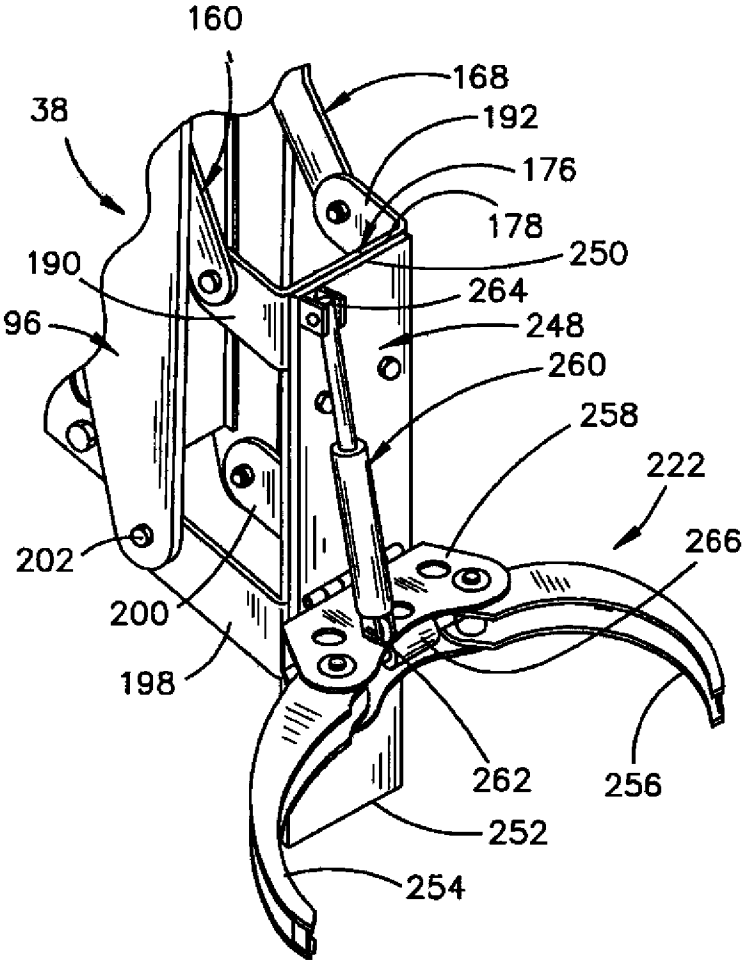
FIG. 13 is a partial perspective view illustrating the grip arm assembly attached to the outer ends of the pivot arms.
Figure 12:
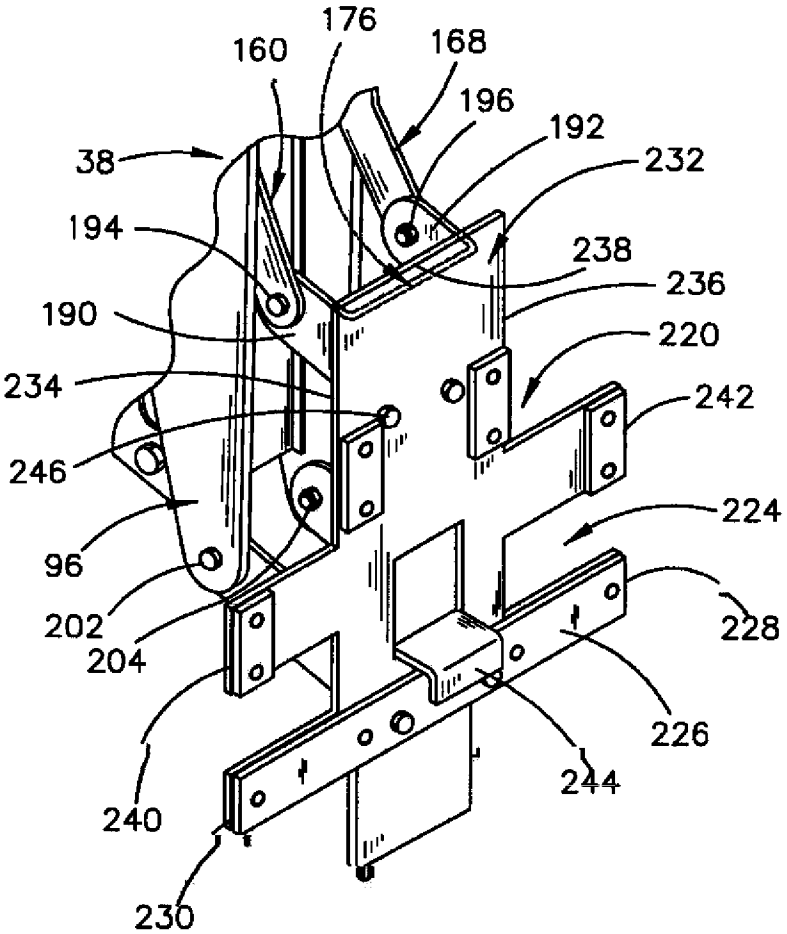
FIG. 12 is a partial perspective view illustrating the hook plate assembly attached to the outer ends of the pivot arms.
Figure 14:
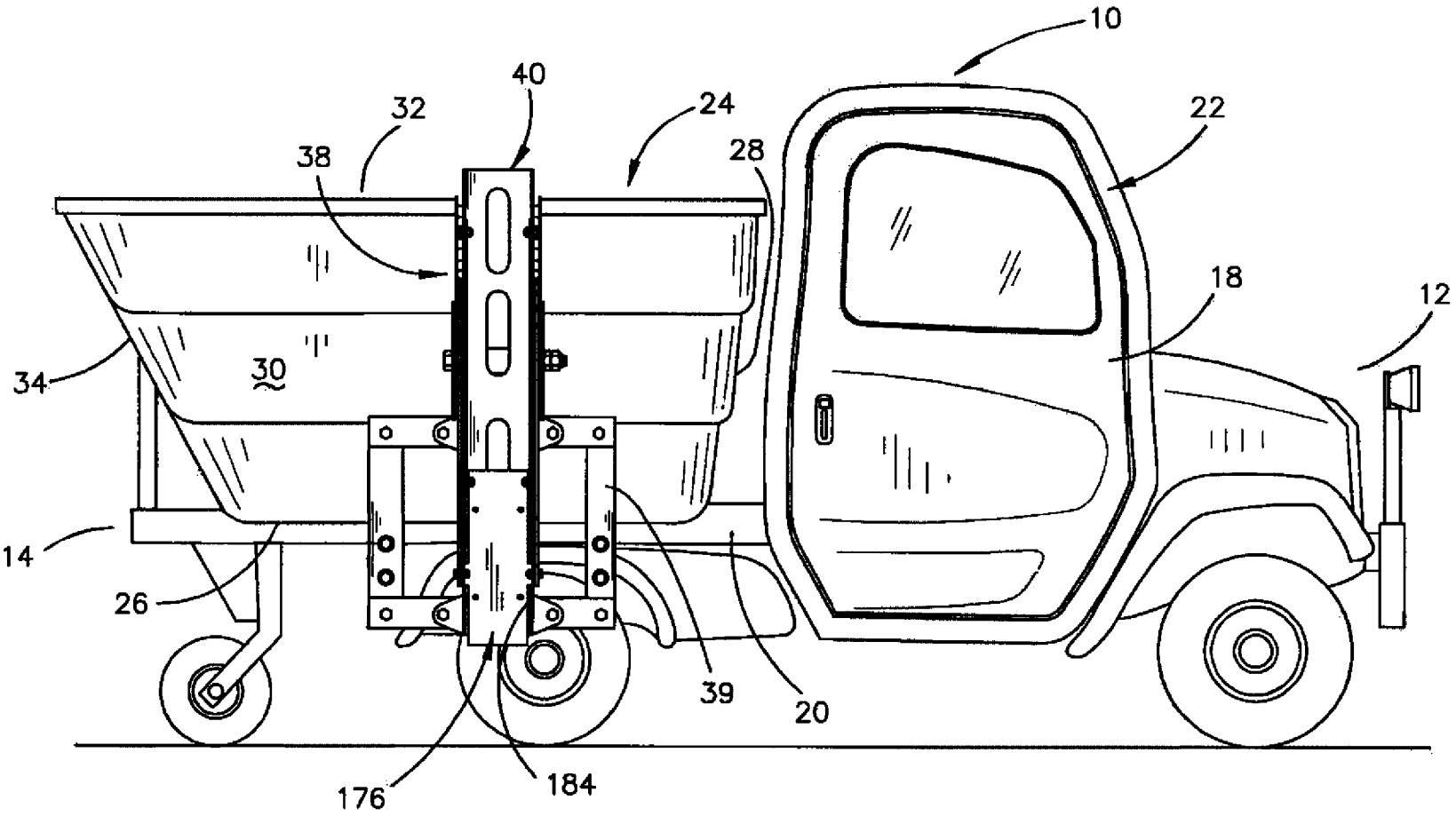
FIG. 14 is a side view of a refuse collection vehicle having the basic lifting arm assembly mounted thereon.
Figure 15:
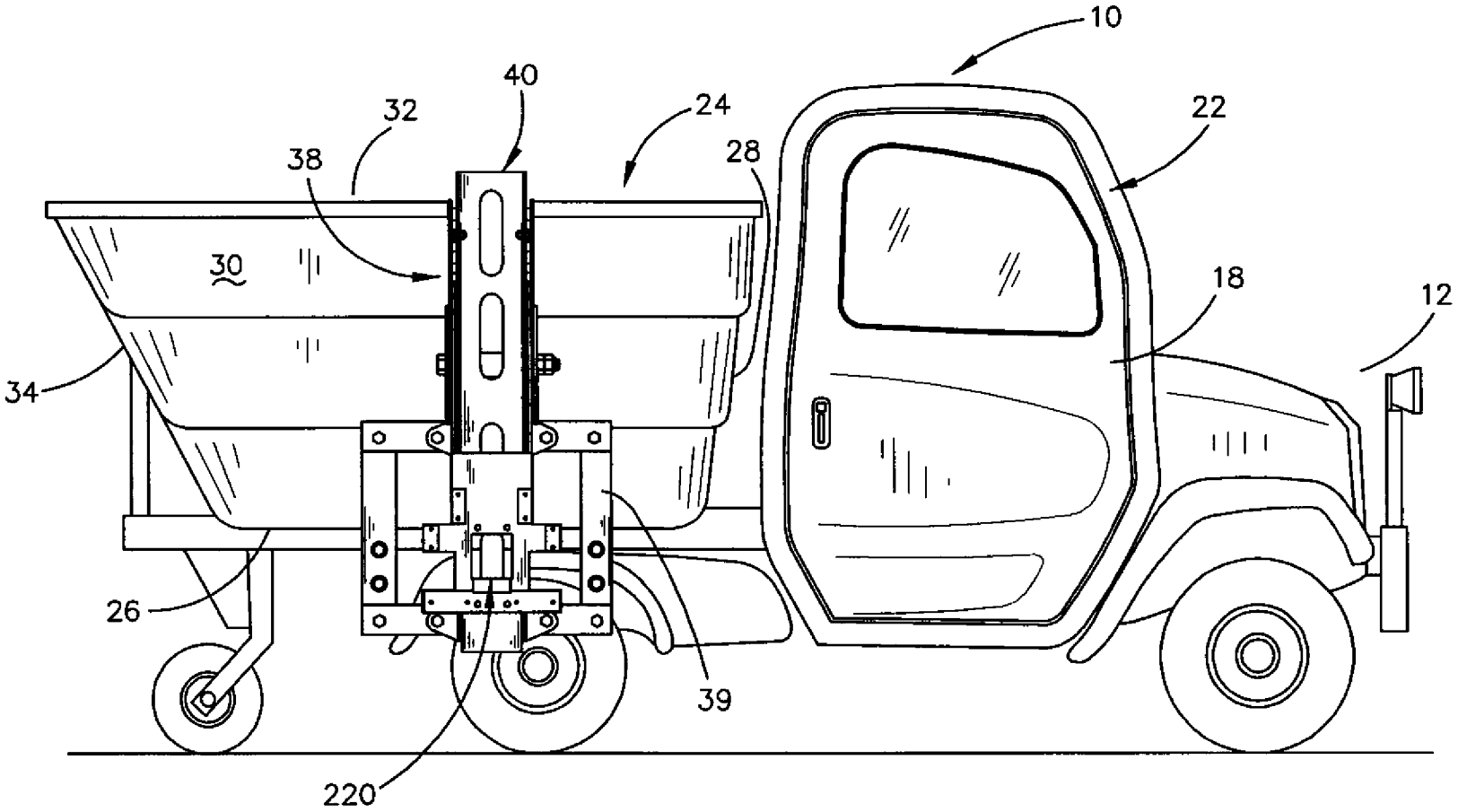
FIG. 15 is a side view similar to FIG. 14 except that a hook plate assembly is attached to the outer ends of the pivot arms.
Figure 16:
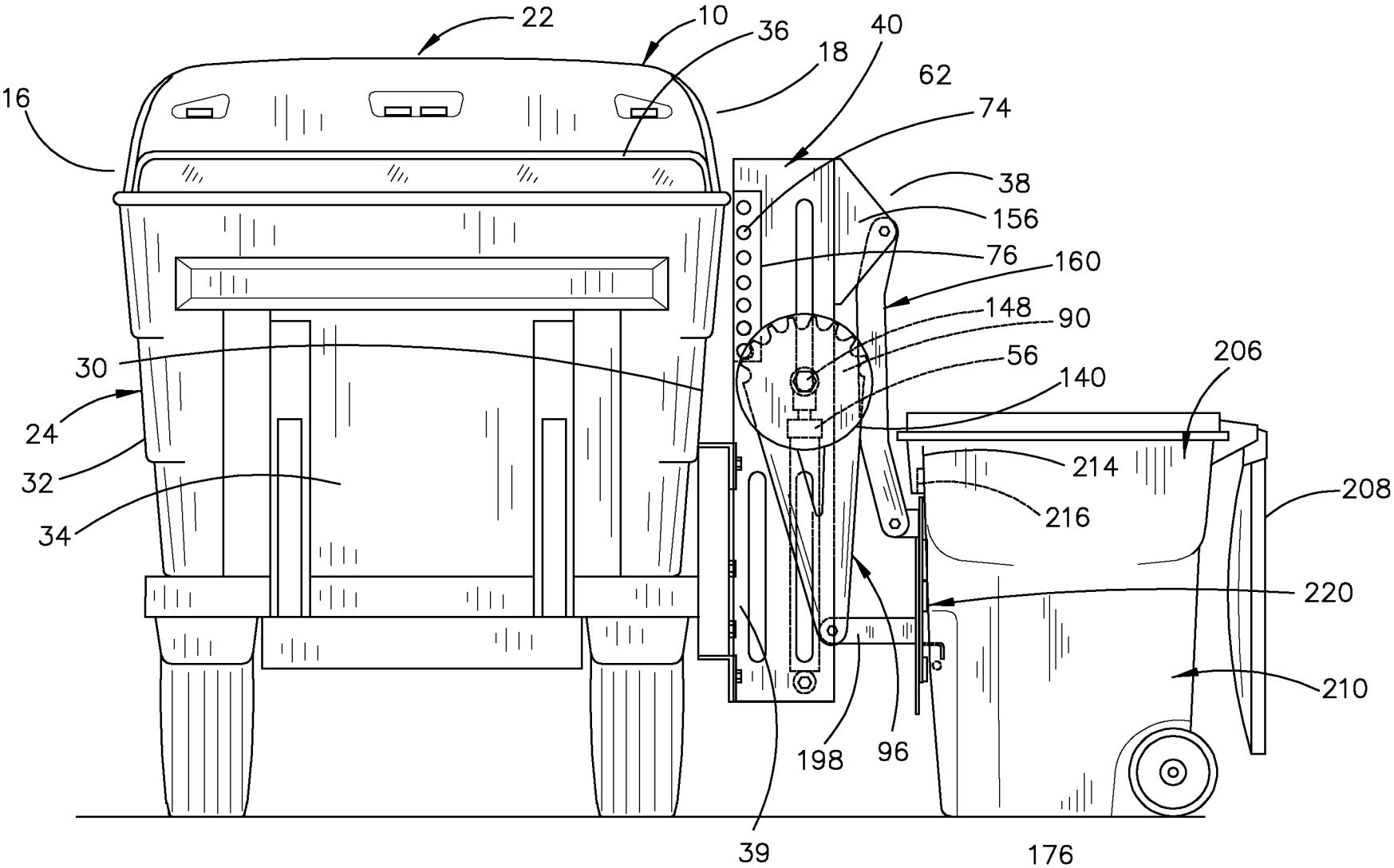
FIG. 16 is a rear view illustrating the hook plate assembly being attached to a refuse container.
Figure 17:
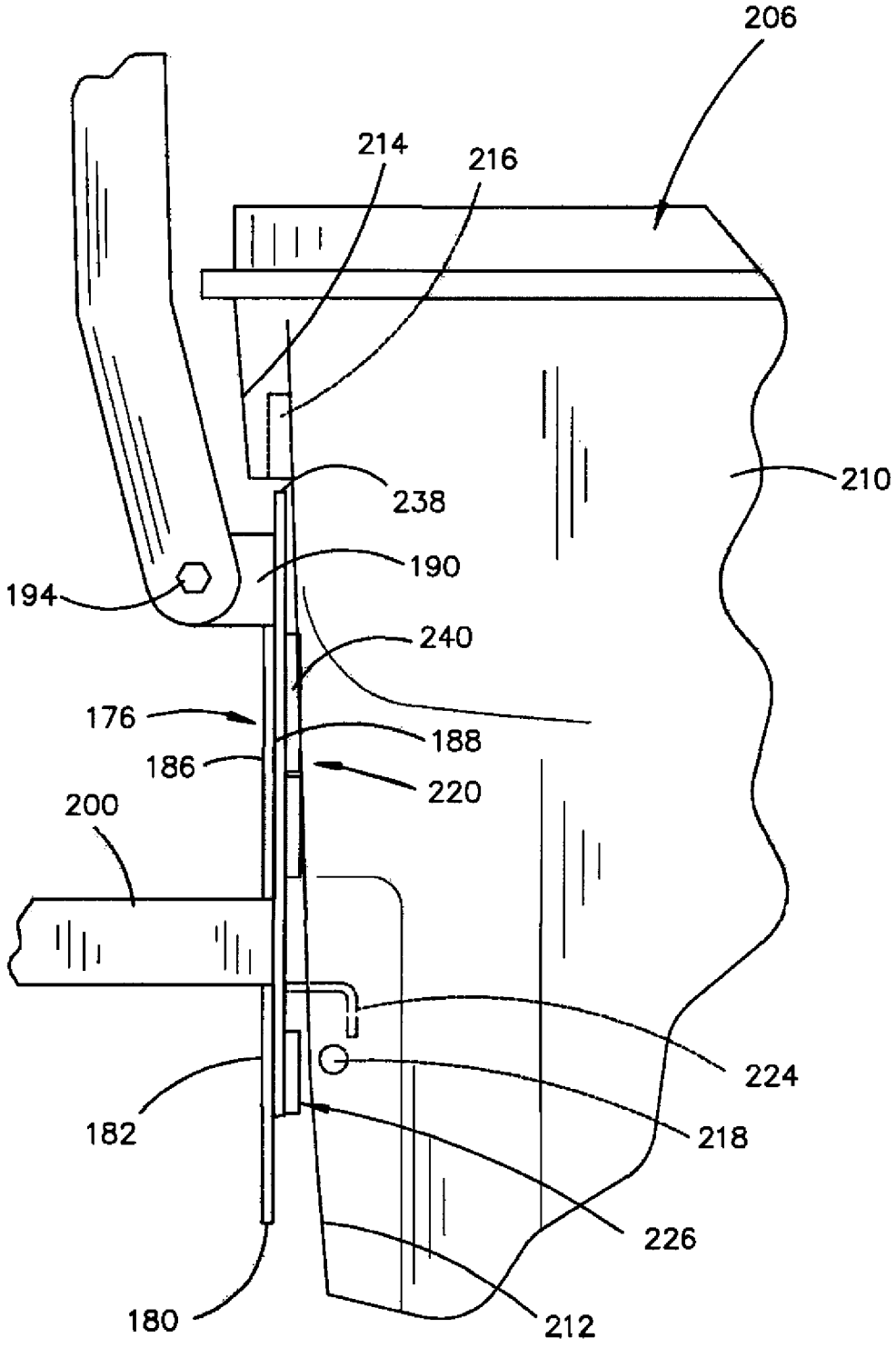
FIG. 17 is a partial rear view of the hook plate assembly being attached to a refuse container.
Figure 18:
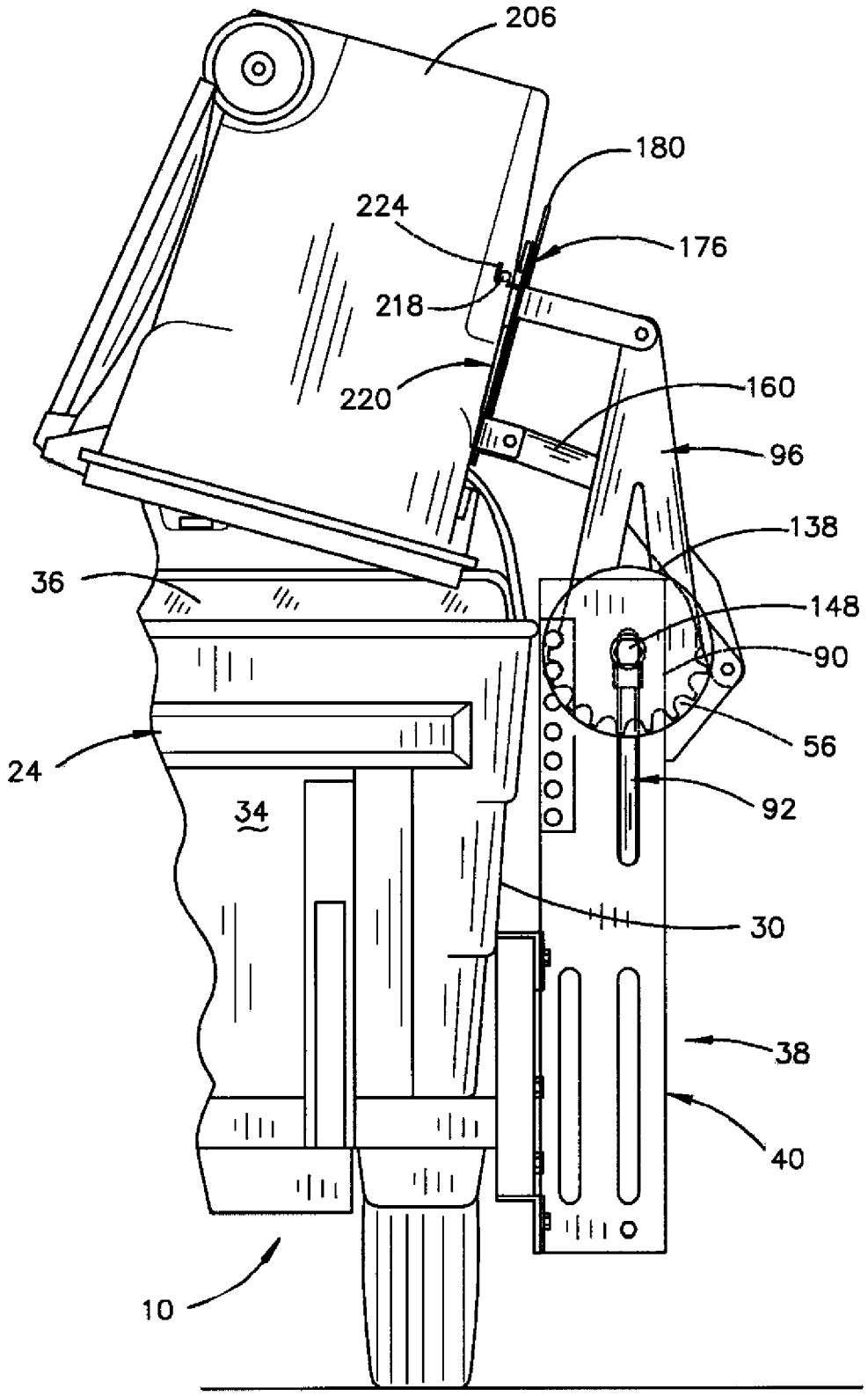
FIG. 18 is a partial rear view illustrating the hook plate assembly and pivot arms in a dumping position.
Figure 19:
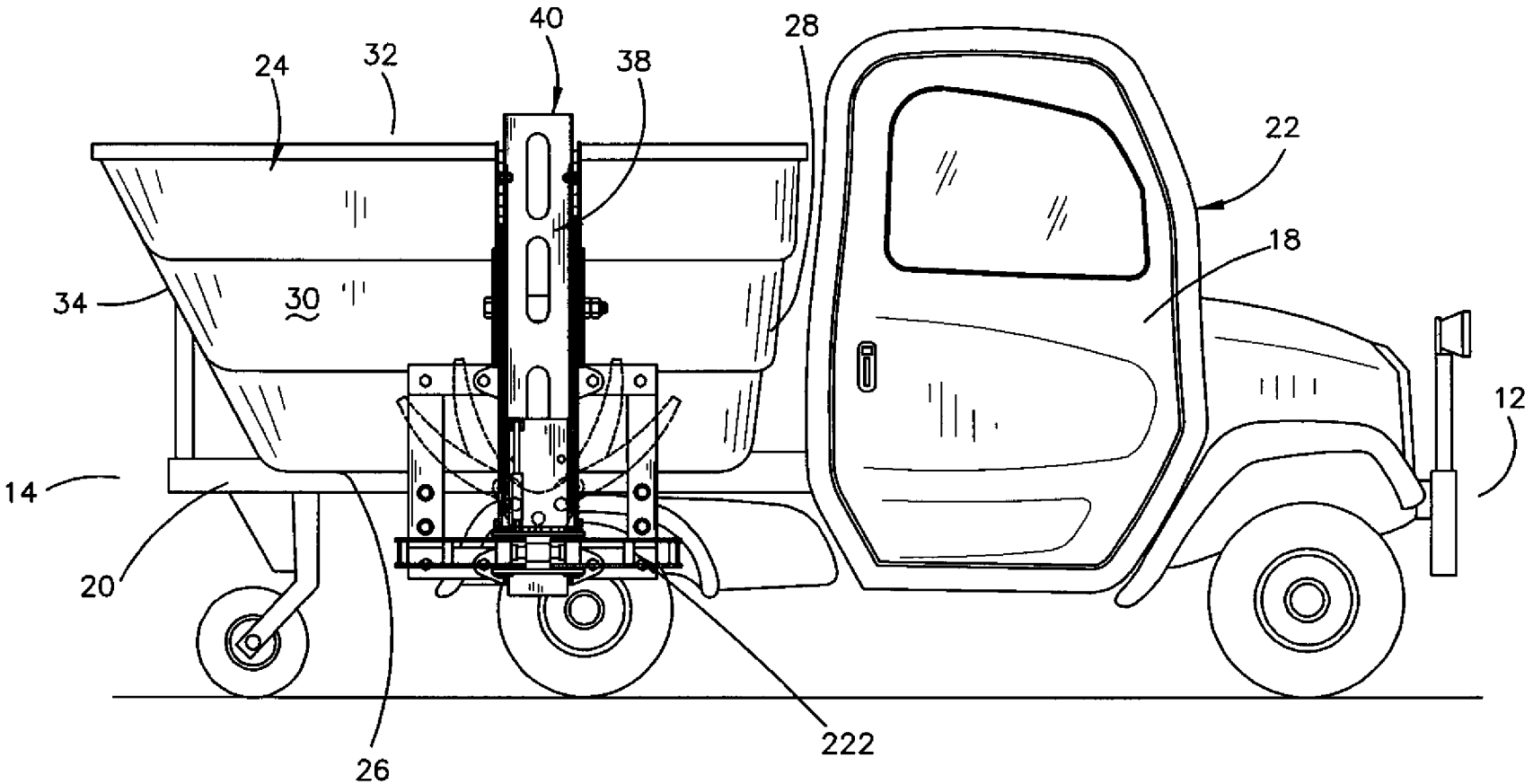
FIG. 19 is a side view similar to FIG. 14 except that a grip arm assembly is attached to the assembly.
Figure 20:
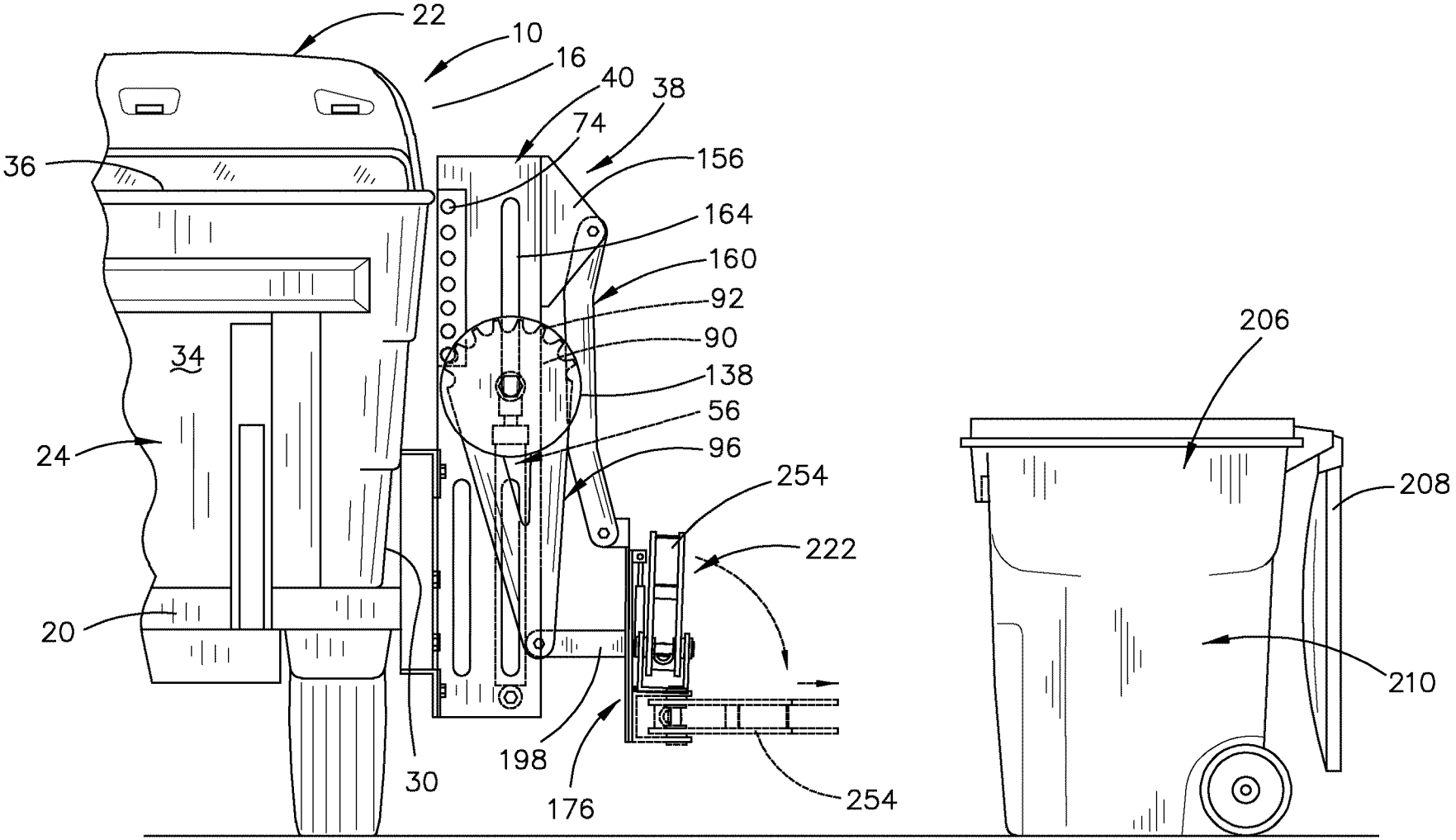
FIG. 20 is an end elevational view illustrating the grip arm assembly in an extended position.
Figure 21:
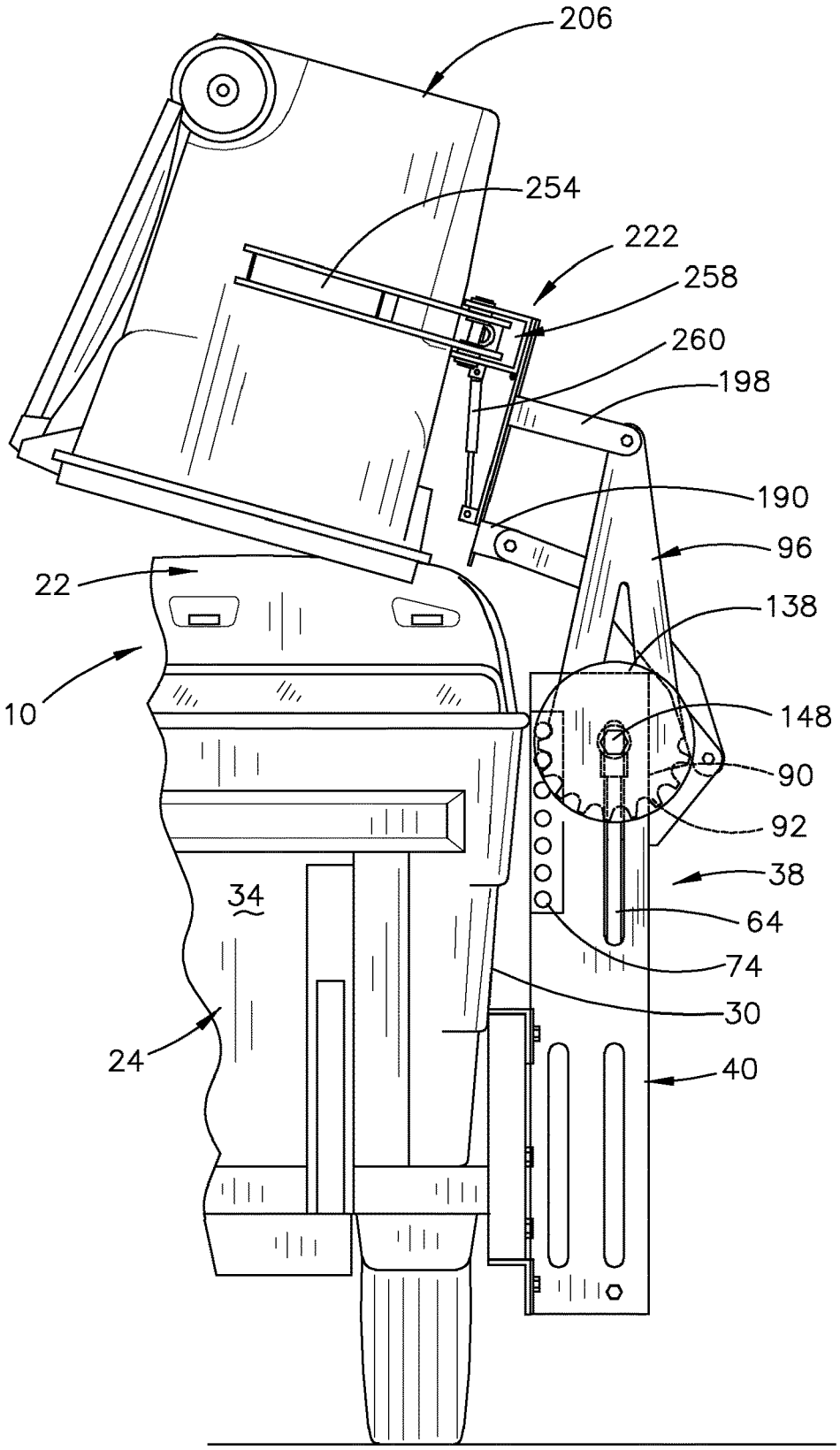
FIG. 21 is a view similar to FIG. 20 except that the grip arm assembly and pivot arms are in the dumping position.

One of the greatest advantages of Applicants' invention is that the assembly 220 may be quickly mounted on mounting bracket 176 and quickly removed therefrom so that the gripper arm assembly 222 may be mounted on mounting bracket 176. The gripper arm assembly 222 includes a vertically disposed plate 248 having an upper end 250 and a lower end 252. A pair of gripping or grasping arms 254 and 256 have their inner ends pivotally secured to a support 258 whereby the arms 254 and 256 may be selectively moved from the open position of FIG. 2. and FIG. 13 to a semi-closed position whereby the arms 254 and 256 may grasp the refuse container 206. The inner end of support 258 is hingedly secured to the lower end of plate 248. A hydraulic cylinder 260 has its base end 282 pivotally secured to support 258 and has its rod end 264 pivotally secured to the upper end of plate 248 so that the arms 254 and 256 may be pivotally moved from the horizontally disposed operative position to the folding transport of FIG. 20. Normally, the arms 254 and 256 are pivotally moved by a hydraulic cylinder 266 or the like.

It can be seen that Applicants have provided a unique lifting arm assembly which enables a refuse container or can to be lifted from a supporting surface to a tipped position above the open upper end of the refuse box of a refuse collection vehicle and to dump the contents of the refuse container into the box of the refuse collection vehicle. It can also be seen that a unique lifting arm assembly may have either a grip arm assembly or a hook plate assembly secured to the outer end of the lifting arms and pivot arms.

Thus, it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. In combination:

a vehicle having a frame with a forward end, a rearward end, a driver's side, and a passenger side;

a refuse box mounted on said frame at said rearward end thereof;

said refuse box including a bottom, an upstanding front wall with upper and lower ends, an upstanding first side wall with upper and lower ends, an upstanding second side wall with upper and lower ends, an upstanding rear wall with upper and lower ends;

each of said front wall, said first side wall, said second side wall, and said rear wall of said refuse box having inner and outer sides;

said refuse box having an open upper end;

an upstanding support member having a lower end, an upper end, a front side, a rear side, an inner side, and an outer side;

said support member being operatively secured to said frame at said passenger side thereof adjacent said outer side of said first side wall of said refuse box;

said front side of said support member having a first vertical row of vertically spaced-apart pin openings formed therein at said inner side of said support member;

said rear side of said support member having a second vertical row of vertically spaced-apart pin openings formed therein at said inner side of said support member;

said pin openings in said first vertical row of pin openings being aligned with said pin openings in said second vertical row of pin openings;

a plurality of elongated and horizontally disposed pins having first and second ends;

said pins extending between said aligned pin openings in said first and second vertical rows of vertically spaced-apart pin openings;

said first ends of said pins being positioned outwardly of said front side of said support member;

said second ends of said pins being positioned outwardly of said rear side of said support member;

said first and second ends of said pins being fixedly secured to said front and rear sides of said support member respectively;

said front side of said support member having a vertically disposed first slot, having upper and lower ends, formed therein;

said rear side of said support member having a vertically disposed second slot, having upper and lower ends, formed therein;

a vertically disposed front pivot plate having an inner end and an outer end;

said inner end of said front pivot plate being secured to said outer side of said support member at said upper end of said support member so as to extend outwardly therefrom;

a vertically disposed rear pivot plate having an inner end and an outer end;

said inner end of said rear pivot plate being secured to said outer side of said support member at said upper end of said support member so as to extend outwardly therefrom;

said front and rear pivot plates being horizontally spaced apart;

a vertically disposed first sprocket arm assembly movably positioned at said front side of said support member;

said first sprocket arm assembly including:

(a) a first sprocket with sprocket teeth;

(b) an elongated first arm having an inner end and an outer end;

(c) said inner end of said first arm being secured to said first sprocket so as to extend therefrom;

a vertically disposed second sprocket arm assembly movably positioned at said front side of said support member;

said second sprocket arm assembly including:

(a) a second sprocket having sprocket teeth;

(b) an elongated second arm having an inner end and an outer end;

(c) said inner end of said second arm secured to said second sprocket so as to extend therefrom;

an elongated front pivot arm having inner and outer ends;

said inner end of said front pivot arm being pivotally secured, about a horizontal axis, to said front pivot plate;

an elongated rear pivot arm having inner and outer ends;

said inner end of said rear pivot arm being pivotally secured, about a horizontal axis, to said rear pivot plate;

said first sprocket being movably positioned adjacent said front side of said support member;

said second sprocket being movably positioned adjacent said rear side of said support member;

a pivot pin extending through said first sprocket, said first slot, said second slot and said second sprocket whereby said first and second sprocket arm assemblies are pivotally movable, about a horizontal axis with respect to said support member and are vertically movable with respect to said support member;

said sprocket teeth of said first sprocket being in mesh with said outer ends of said pins at said front side of said support member;

said sprocket teeth of said second sprocket being in mesh with said outer ends of said pins at said rear side of said support member;

a vertically disposed hydraulic cylinder, having a base end and a rod end, positioned in said support member;

said base end of said hydraulic cylinder being secured to said support member;

said rod end of said hydraulic cylinder being connected to said pivot pin for vertically moving said first and second sprocket arm assemblies with respect to said support member; and a can engagement assembly pivotally secured to said outer ends of said first and second arms and pivotally secured to said outer ends of said front and rear pivot arms.

2. The combination of claim 1 wherein said can engagement assembly is a can grip assembly.

3. The combination of claim 1 wherein said can engagement assembly is a hook plate assembly.

4. The combination of claim 1 wherein said can engagement assembly is selectively removably secured to said outer ends of said first and second arms and said outer ends of said front and rear pivot arms so that either a can grip assembly or a hook plate assembly may be secured to said outer ends of said first and second arms and said outer ends of said front and rear pivot arms.

5. In combination:

a vehicle having a frame with a forward end, a rearward end, a driver's side, and a passenger side;

a refuse box mounted on said frame at said rearward end thereof;

said refuse box including a bottom, an upstanding front wall with upper and lower ends, an upstanding first side wall with upper and lower ends, an upstanding second side wall with upper and lower ends, an upstanding rear wall with upper and lower ends;

each of said front wall, said first side wall, said second side wall, and said rear wall of said refuse box having inner and outer sides;

said refuse box having an open upper end;

an upstanding support member having a lower end, an upper end, a front side, a rear side, an inner side, and an outer side;

said support member being operatively secured to said frame at said passenger side thereof adjacent said outer side of said first side wall of said refuse box;

said front side of said support member having a first vertical row of vertically spaced-apart pin openings formed therein at said inner side of said support member;

said rear side of said support member having a second vertical row of vertically spaced-apart pin openings formed therein at said inner side of said support member;

said pin openings in said first vertical row of pin openings being aligned with said pin openings in said second vertical row of pin openings;

a plurality of elongated and horizontally disposed pins having first and second ends;

said pins extending between said aligned pin openings in said first and second vertical rows of vertically spaced-apart pin openings;

said first ends of said pins being positioned outwardly of said front side of said support member;

said second ends of said pins being positioned outwardly of said rear side of said support member;

said first and second ends of said pins being fixedly secured to said front and rear sides of said support member respectively;

said front side of said support member having a vertically disposed first slot having upper and lower ends, formed therein;

said rear side of said support member having a vertically disposed second slot, having upper and lower ends, formed therein;

a vertically disposed front pivot plate having an inner end and an outer end;

said inner end of said front pivot plate being secured to said outer side of said support member at said upper end of said support member so as to extend outwardly therefrom;

a vertically disposed rear pivot plate having an inner end and an outer end;

said inner end of said rear pivot plate being secured to said outer side of said support member at said upper end of said support member so as to extend outwardly therefrom;

said front and rear pivot plates being horizontally spaced apart;

a vertically disposed first sprocket arm assembly movably positioned at said front side of said support member;

said first sprocket arm assembly including:

(a) a first sprocket with sprocket teeth;

(b) an elongated first arm having an inner end and an outer end;

(c) said inner end of said first arm being secured to said first sprocket so as to extend therefrom;

a vertically disposed second sprocket arm assembly movably positioned at said front side of said support member;

said second sprocket arm assembly including:

(a) a second sprocket having sprocket teeth;

(b) an elongated second arm having an inner end and an outer end;

(c) said inner end of said second arm secured to said second sprocket so as to extend therefrom;

an elongated front pivot arm having inner and outer ends;

said inner end of said front pivot arm being pivotally secured, about a horizontal axis, to said front pivot plate;

an elongated rear pivot arm having inner and outer ends;

said inner end of said rear pivot arm being pivotally secured, about a horizontal axis, to said rear pivot plate;

said first sprocket being movably positioned adjacent said front side of said support member;

said second sprocket being movably positioned adjacent said rear side of said support member;

a pivot pin extending through said first sprocket, said first slot, said second slot and said second sprocket whereby said first and second sprocket arm assemblies are vertically movable with respect to said front and rear sides of said support member and whereby said first and second sprocket arm assemblies are pivotally movable, about a horizontal axis with respect to said support member and are vertically movable with respect to said support member;

said sprocket teeth of said first sprocket being in mesh with said outer ends of said pins at said front side of said support member;

said sprocket teeth of said second sprocket being in mesh with said outer ends of said pins at said rear side of said support member;

a vertically disposed hydraulic cylinder, having a base end and a rod end, positioned in said support member;

said base end of said hydraulic cylinder being secured to said support member;

said rod end of said hydraulic cylinder being connected to said pivot pin for vertically moving said first and second sprocket arm assemblies with respect to said support member;

a can engagement assembly pivotally secured to said outer ends of said first and second arms and pivotally secured to said outer ends of said front and rear pivot arms; and said can engagement assembly being a can grip assembly.

6. In combination:

a vehicle having a frame with a forward end, a rearward end, a driver's side, and a passenger side;

a refuse box mounted on said frame at said rearward end thereof;

said refuse box including a bottom, an upstanding front wall with upper and lower ends, an upstanding first side wall with upper and lower ends, an upstanding second side wall with upper and lower ends, an upstanding rear wall with upper and lower ends;

each of said front wall, said first side wall, said second side wall, and said rear wall of said refuse box having inner and outer sides;

said refuse box having an open upper end;

an upstanding support member having a lower end, an upper end, a front side, a rear side, an inner side, and an outer side;

said support member being operatively secured to said frame at said passenger side thereof adjacent said outer side of said first side wall of said refuse box;

said front side of said support member having a first vertical row of vertically spaced-apart pin openings formed therein at said inner side of said support member;

said rear side of said support member having a second vertical row of vertically spaced-apart pin openings formed therein at said inner side of said support member;

said pin openings in said first vertical row of pin openings being aligned with said pin openings in said second vertical row of pin openings;

a plurality of elongated and horizontally disposed pins having first and second ends;

said pins extending between said aligned pin openings in said first and second vertical rows of vertically spaced-apart pin openings;

said first ends of said pins being positioned outwardly of said front side of said support member;

said second ends of said pins being positioned outwardly of said rear side of said support member;

said first and second ends of said pins being fixedly secured to said front and rear sides of said support member respectively;

said front side of said support member having a vertically disposed first slot having upper and lower ends, formed therein;

said rear side of said support member having a vertically disposed second slot, having upper and lower ends, formed therein;

a vertically disposed front pivot plate having an inner end and an outer end;

said inner end of said front pivot plate being secured to said outer side of said support member at said upper end of said support member so as to extend outwardly therefrom;

a vertically disposed rear pivot plate having an inner end and an outer end;

said inner end of said rear pivot plate being secured to said outer side of said support member at said upper end of said support member so as to extend outwardly therefrom;

said front and rear pivot plates being horizontally spaced apart;

a vertically disposed first sprocket arm assembly movably positioned at said front side of said support member;

said first sprocket arm assembly including:

(a) a first sprocket with sprocket teeth;

(b) an elongated first arm having an inner end and an outer end;

(c) said inner end of said first arm being secured to said first sprocket so as to extend therefrom;

a vertically disposed second sprocket arm assembly movably positioned at said front side of said support member;

said second sprocket arm assembly including:

(a) a second sprocket having sprocket teeth;

(b) an elongated second arm having an inner end and an outer end;

(c) said inner end of said second arm secured to said second sprocket so as to extend therefrom;

an elongated front pivot arm having inner and outer ends;

said inner end of said front pivot arm being pivotally secured, about a horizontal axis, to said front pivot plate;

an elongated rear pivot arm having inner and outer ends;

said inner end of said rear pivot arm being pivotally secured, about a horizontal axis, to said rear pivot plate;

said first sprocket being movably positioned adjacent said front side of said support member;

said second sprocket being movably positioned adjacent said rear side of said support member;

a pivot pin extending through said first sprocket, said first slot, said second slot and said second sprocket whereby said first and second sprocket arm assemblies are vertically movable with respect to said front and rear sides of said support member and whereby said first and second sprocket arm assemblies are pivotally movable, about a horizontal axis with respect to said support member and are vertically movable with respect to said support member;

said sprocket teeth of said first sprocket being in mesh with said outer ends of said pins at said front side of said support member;

said sprocket teeth of said second sprocket being in mesh with said outer ends of said pins at said rear side of said support member;

a vertically disposed hydraulic cylinder, having a base end and a rod end, positioned in said support member;

said base end of said hydraulic cylinder being secured to said support member;

said rod end of said hydraulic cylinder being connected to said pivot pin for vertically moving said first and second sprocket arm assemblies with respect to said support member;

a can engagement assembly secured to said outer ends of said first and second arms and secured to said outer ends of said front and rear pivot arms; and said can engagement assembly being a hook plate assembly.

* * * * *